United States Patent [19]

Bixler

[11] Patent Number: 4,821,901

[45] Date of Patent: Apr. 18, 1989

[54] FILLER FLAT CONSTRUCTION

[75] Inventor: Kenneth D. Bixler, Lake Forest, Ill.

[73] Assignee: Packaging Corporation of America, Evanston, Ill.

[21] Appl. No.: 163,266

[22] Filed: Mar. 2, 1988

[51] Int. Cl.[4] ..... B65Q 85/32

[52] U.S. Cl. ..... 217/18; 206/520; 217/26.5

[58] Field of Search ..... 229/2.5 EC; 206/518–520, 521.3, 521.8; 217/18, 25.5, 26, 26.5, 27

[56] References Cited

U.S. PATENT DOCUMENTS

| | | | |
|---|---|---|---|
| 2,950,726 | 8/1960 | Kuhl et al. | 217/26 |
| 3,120,901 | 2/1964 | Boyd | 206/520 |
| 3,451,577 | 6/1969 | Nurick | 217/26.5 |
| 4,280,648 | 7/1981 | Boursier | 206/520 |

FOREIGN PATENT DOCUMENTS

| | | | |
|---|---|---|---|
| 17993 | 1/1935 | Australia | 217/26 |
| 282437 | 12/1965 | Australia | 217/26.5 |

*Primary Examiner*—Stephen Marcus

*Assistant Examiner*—Gary E. Elkins

*Attorney, Agent, or Firm*—Neuman, Williams, Anderson & Olson

[57] ABSTRACT

A filler flat construction for accommodating a plurality of fragile articles is provided which includes a plurality of article-accommodating cells arranged in side by side relation and forming substantially parallel rows. Adjacent cells in a row are separated by upstanding first shoulders, and corresponding cells in adjoining rows are separated by upright second shoulders. The first and second shoulders of a cell are angularly disposed and interconnected by upstanding hollow corner posts. Each post projects upwardly to a greater extent than the interconnected shoulders and the portion of the post which is elevated relative to the interconnected shoulders is provided with open side walls facing adjacent cells. The upper end portions of the open side walls of the post are interconnected by a cap section. Each cell includes a base section which is substantially delimited by wall segments extending divergently upwardly therefrom. The wall segments form surfaces of the shoulders and corner posts surrounding each cell.

8 Claims, 2 Drawing Sheets

FIG. 1
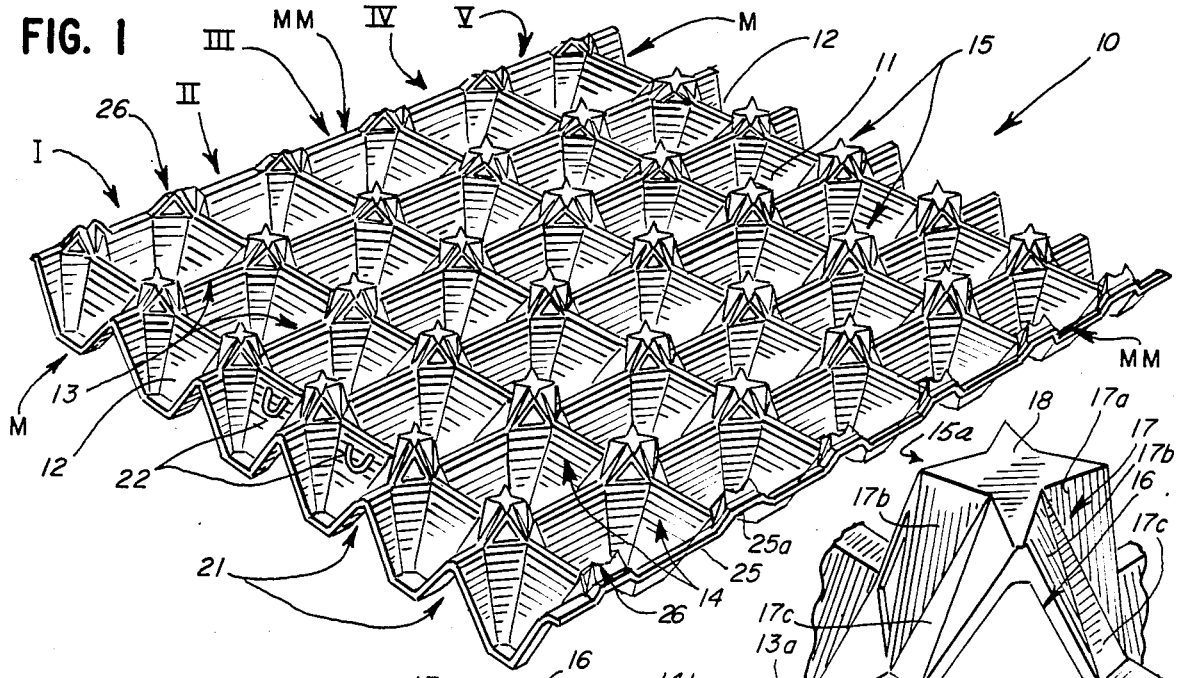
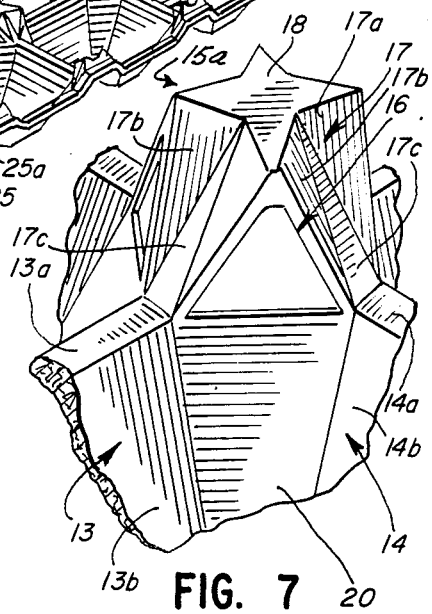
FIG. 7
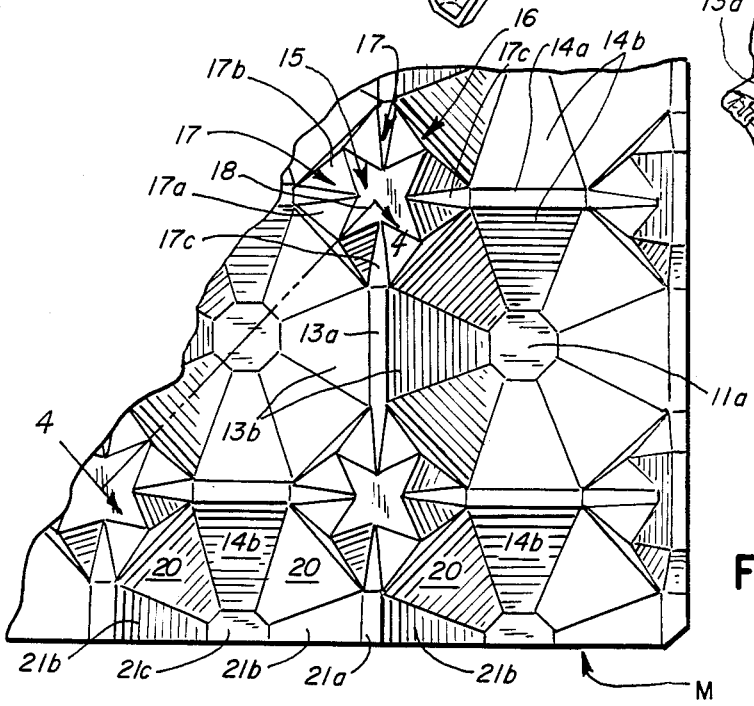
FIG. 2
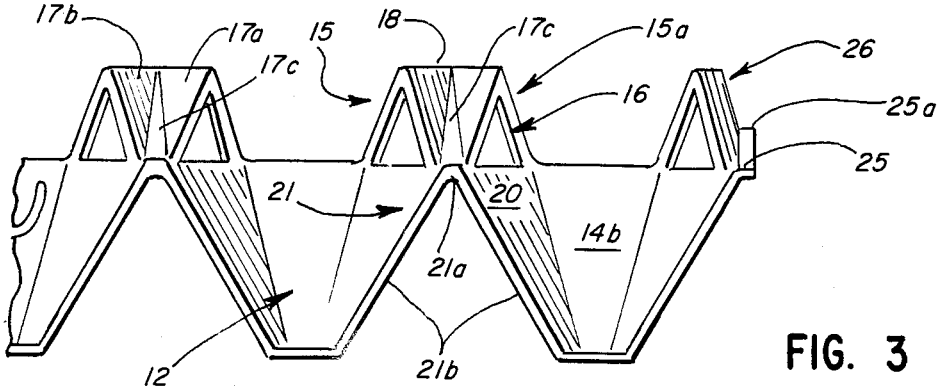
FIG. 3

FILLER FLAT CONSTRUCTION

BACKGROUND OF THE INVENTION

The utilization of filler flats for the packaging and distribution in bulk of a plurality of fragile articles, such as eggs, to commercial and institutional customers has been popular for many years because of the low packaging costs involved and the ease of handling the packaged articles. Such filler flats, often referred to as egg trays, customarily have a uniform peripheral dimension so as to fit in conventional corrugated shipping containers or egg cases. Such containers usually have a capacity to accommodate 30 dozen eggs. The filler flats are generally formed of molded pulp and are initially shipped to the packers in bundles of nested flats. Because of the surface configuration of the flats, which consists of cells and upstanding posts, and the compactness of the bundles, difficulty has been encountered in removing or denesting individual flats from the bundle. Furthermore, because of the surface configuration of the prior flats, uniform drying of the pulp after the flats have been molded has been a problem requiring extended drying periods or resulting in warpage of some of the flats. The cell designs of the prior flats have frequently made loading and unloading of the flats an awkward manipulation resulting in an inordinate amount of egg breakage.

SUMMARY OF THE INVENTION

Thus, it is an object of the invention to provide a filler flat which avoids all of the aforementioned shortcomings associated with prior constructions.

It is a further object to provide an improved filler flat which incorporates cell and post designs which allow for substantial savings in material and shipping costs.

It is a further object to provide an improved filler flat incorporating unique open post designs which effect more expeditious and efficient drying heat circulation, thus markedly reducing moisture buildup or concentration in portions of the posts.

It is a still further object to provide an improved filler flat which effects better side to side support for the egg when accommodated in a cell notwithstanding that the eggs may vary in size and shape over a wide range.

A further advantage of the improved filler flat is that the open post design allows better circulation of cooling air and thus, faster egg cool down which preserves the egg quality.

A still further advantage of the improved filler flat resides in the location of the finger openings in marginal portions of the filler flat which facilitates manual removal of individual loaded filler flats from the shipping container.

An additional advantage of the improved filler flat resides in the peripheral configuration of the filler flat whereby the latter may be readily and smoothly engaged by one or more pusher bars while being moved in a lateral direction by automatic handling equipment.

Further and additional objects will appear from the description, accompanying drawings and appended claims.

In accordance with one embodiment of the invention, an improved filler flat for accommodating a plurality of fragile articles, such as eggs, has been provided which incorporates a plurality of cells arranged in parallel rows. Adjacent cells in a row are separated from one another by upwardly extending hollow first shoulders.

Corresponding cells in adjoining rows are separated by upwardly extending hollow second shoulders, the latter being angulaly disposed relative to the first shoulders. The first and second shoulders are interconnected by upstanding hollow corner posts which extend upwardly to a greater extent than the interconnected shoulders. The portion of each post, which is elevated relative to the interconnected shoulders, is provided with open side walls which face the adjacent cells. The upper end portions of the open side walls of each post are interconnected by a cap section. Each cell includes a base section which is delimited by wall segments extending divergently upwardly. Certain of the wall segments define cell-forming surfaces of the first and second shoulders and the remaining wall segments define cell-forming surfaces of the corner posts and extend to the open side walls of the posts.

DESCRIPTION

For a more complete understanding of the invention, reference is made to the drawings wherein:

FIG. 1 is a perspective top view of one embodiment of the improved filler flat.

FIG. 2 is an enlarged fragmentary top plan view of the filler flat of FIG. 1.

FIG. 3 is a fragmentary side elevational view of the filler flat of FIG. 2.

FIG. 7 is an enlarged fragmentary perspective view of one corner post.

Figure 4:
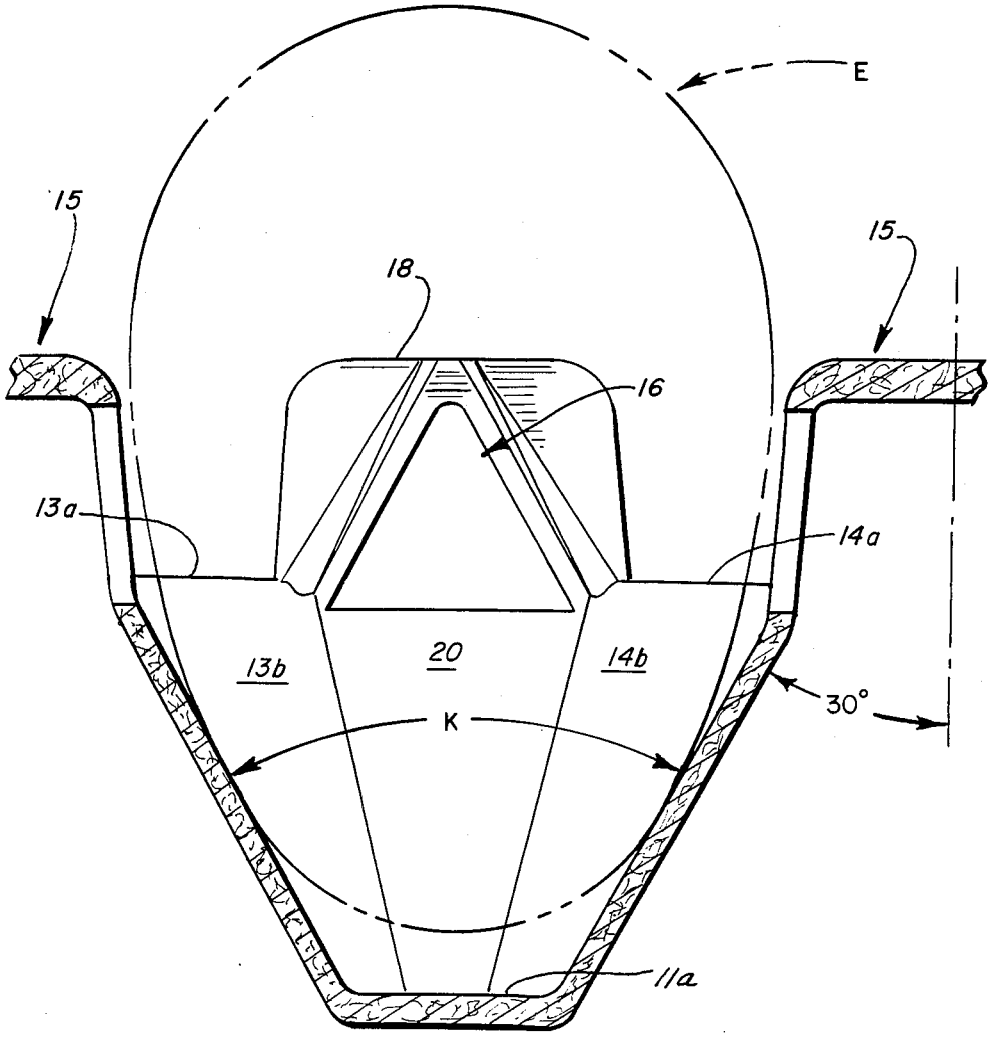
FIG. 4 is an enlarged fragmentary sectional view of a cell taken along line 4—4 of FIG. 2 and showing in phantom lines an egg accommodated in the cell.

Referring now to the drawings and more particularly to FIG. 1 a preferred embodiment of an improved filler flat, or egg tray, 10 is shown which is formed of molded pulp. The tray includes a plurality of cells 11 which are arranged in parallel rows I–V. The number of rows and the number of cells included in a row may vary from that shown. In the egg packing industry the standard egg tray consists of five rows of full cells with six cells per row, thus accommodating 2½ dozen eggs. Two opposing marginal sections M of the tray 10 are of like configuration and each is formed of a row of half cells 12. Thus, each tray has a square peripheral configuration.

Adjacent cells 11 in a row are separated from one another by upwardly extending hollow first shoulders 13. In a similar manner corresponding cells in adjoining rows are separated form one another by upwardly extending hollow second shoulders 14. Shoulders 13 and 14 are of like configuration and each has a substantially inverted V shape cross-section. The shoulders 13 and 14 are arranged substantially perpendicular to one another and are interconnected by upstanding hollow corner posts 15. Each post is of like configuration and has an upper portion **15*a* thereof which projects a substantial amount above the upper extremity, or ridge portion, 13*a*, 14*a* of the adjacent shoulder 13 or 14. As seen in FIG. 7, portion 15*a* includes a plurality of open sidewalls 16, each of which faces an adjacent cell 11. Adjacent side walls 16 of each post upper portion 15*a* are separated from one another by recessed, flute-like wall sections 17. Each section 17 is formed of a pair of triangular gusset-like segments 17***a*,17*b* which converge inwardly from corresponding peripheral portions of the open side walls towards one another and terminate at a recessed, tapered inner wall 17*c*. Each inner wall 17*c* is in endwise alignment and integral with the ridge portion 13*a* or 14*a* of an adjacent shoulder 13 or 14. The gusset-like segments 17*a*,17*b* emanating from an open side wall 16, impart a triangular configuration to the open side wall.

The upper extremities of the open side walls 16, the inner walls 17*c* and the gusset-like segments 17*a*,17*b* of a corner post 15 are interconnected by a cap section 18. In the illustrated embodiment, the cap section 18 has a star shape. The cap sections form a horizontal first plane.

Extending downwardly from the post open side wall 16 towards a central axis of an adjacent cell 11 is a lower side wall 20, the latter forming a portion of the upstanding wall of the adjacent cell. Besides the post lower side walls 20, the remainder of the cell upstanding wall includes opposing wall surfaces 13*b* forming portions of adjacent first shoulders 13 and opposing wall surfaces 14*b* of adjacent second shoulders 14. The opposing shoulder wall surfaces convergent downwardly from the respective ridge portions 13*a*,14*a* of the shoulders and terminate at a cell base section 11*a*. As seen in FIGS. 2 and 4 the cell base section 11*a* is substantially planar and has an octagonal configuration. The cell base sections form a second horizontal plane which is parallel to the first plane formed by the cap sections of the corner posts.

The inclination of each cell wall segment (e.g. surface 13*b*, 14*b* or 20) is approximately 30° to a vertical axis, with the result that each cell has a significantly greater open angle K and thus, is capable of accommodating eggs which vary in size and shape over a wide range. In addition the upper portions 15*a* of the posts with the open side walls 16 provide superior side to side egg support and thus protect against side checks or fissures being formed in the accommodated eggs.

The open side walls 16 of the posts 15 are multi-functional. First, they result in advantages during production of the tray in that better drying heat circulation occurs, thus avoiding moisture buildup which normally results in conventional post designs. Second, avoiding moisture buildup in the posts reduces significantly curing time during the production of the tray. Third, the open side walls allow easier finger entry into the cell thereby facilitating manual removal of the egg or article from the cell. Lastly, the open side walls of the posts permit better ventilation around the accommodated eggs particularly when the loaded trays are in stacked relation; thus, effecting faster egg cool down and better preservation of the egg quality.

As aforementioned the opposing marginal sections M of the tray 10 include a row of half cells 12. Adjacent half cells 12 are separated from one another by a half shoulder 21. Each half shoulder 21 is in endwise alignment with a first shoulder 13 and is separated from the latter by an intervening corner post 15. Shoulder 13 and half shoulder 21 have similar inverted V-shape cross-sectional configurations. Each half-shoulder 21 has a substantially horizontal ridge portion 21*a* and downwardly extending divergent side walls 21*b*. The bottom edges of the side walls 21*b* terminate at a base section 21*c* of the half cell 21. The remainder of each half cell 21 is formed by the lower side walls 20 of adjacent corner posts 15 and a depending side wall 14*b* of an adjacent second shoulder 14.

Figure 6:
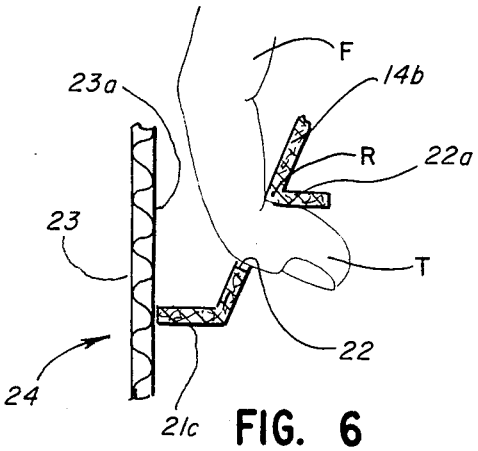
FIG. 6 is an enlarged fragmentary vertical sectional view of the filler flat of FIG. 1 shown being manually removed from a conventional shipping container.

As seen in FIG. 1, the two center half cells 12 along each marginal section M, have finger openings 22 formed in the depending side wall 14*b* of each of the two cells. Because the side walls 14*b* of the two center half-cells 12 are recessed from the peripheral edge of the tray 10, fingers F may be readily positioned between the interior surface 23*a* of a vertical side wall 23 of an egg case 24 and the side walls 14*b* of the two center half cells 12 and the tips T of the fingers inserted through the openings 22, see FIG. 6, allowing a loaded tray to be conveniently placed in or removed from the egg case interior.

Each opening 22 has a tab 22*a* foldably connected to an upper perimetric segment of the opening. When the fingertip T is inserted through the opening, the tab 22*a* will be folded inwardly providing a rounded edge R to be comfortably engaged by the fingertip T. Furthermore, the hollow interior of the shoulder 14 does not present any obstruction to the inserted fingertip.

In commercial egg packing plants, it is customary for individual egg trays to be mechanically denested or removed from a bundle of stacked trays. The denested tray is then positioned on a suitable conveyor C, see FIG. 5, with the tray cells facing upwardly. The individual trays are then conveyed to a loading station where a required number of eggs corresponding to the number of tray cells are automatically deposited into the cells. After the tray has been loaded, it is moved to a second station where the tray is pushed off the conveyor onto a horizontal surface. The tray is manually removed from the horizontal surface and placed in the egg case.

Figure 5:
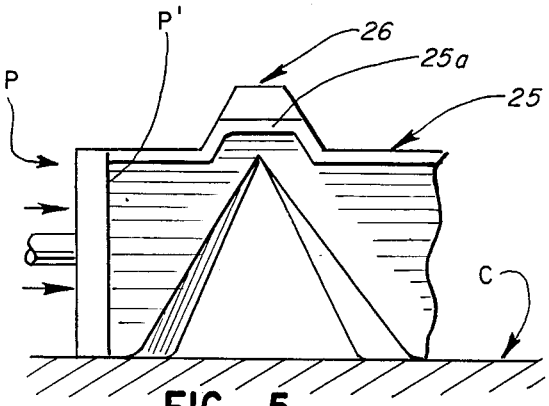
FIG. 5 is a fragmentary side elevational view of the filler flat of FIG. 1 with a marginal portion of the flat being engaged by a pusher bar.

While the tray is being conveyed to various stations and/or is being pushed off the conveyor at a given station, a pusher bar P, see FIG. 5, is frequently utilized to impart the desired movement to the tray. Such a bar is normally provided with a flat end face P′ which is perpendicular to the direction of movement of the bar. The bar end face P′ is intended to engage a marginal section of the tray. However, in numerous prior egg trays the marginal section engaged by the bar consists of a segment of an elevated flange which encompasses the tray. If the bar is not properly sized relative to the elevated flange or if the tray marginal section is warped, the bar will slide under the elevated flange and engage the inclined exterior surfaces of the egg cells disposed in the row adjacent the marginal section causing the tray to be tilted at a substantial angle. When the tilted tray is empty and located at the loading station, difficulty may be encountered in properly depositing the eggs in the cells. When, on the other hand, the tilted tray is loaded possible contacting of eggs in adjacent cells might occur causing checking or cracking of the eggs.

Tilting of the tray by the pusher bar P is avoided in tray 10 because the pusher bar engages the end faces of the half shoulders 21 which are of substantial height and form a vertical plane, see FIGS. 3 and 5. When the denested tray 10 is deposited on the conveyor it is oriented so that the marginal portions M will be engaged by the pusher bar.

As seen in FIGS. 1 and 5 the marginal sections MM which are disposed at right angles to marginal sections M, are of like configuration and each includes a narrow flange 25 having upwardly offset portions 25*a*, the latter being aligned with the rows of corner posts 15. The offset portions 25*a* provide support for the partial corner posts 26 which are disposed adjacent the marginal sections MM. The portions of the partial posts 26, which face the adjacent cells 11, have a configuration like that of the corner posts 15 which were previously described.

It will be noted in FIGS. 3 and 7, that the thickness of the molded pulp is greater at the ridge portions 21*a*, 13*a* and 14*a* of the half shoulders 21 and shoulders 13 and 14 and thus, such thickened ridge portions prevent jamming of the empty trays together when they are nested to form bundles. If the empty trays are jammed together serious denesting problems can occur. Thus, the configuration of tray 10 avoids the serious denesting problems which are associated with certain prior structures.

While tray 10 has been described in relation to accommodating eggs, it is not limited thereto but may be used for packaging other fragile articles, such as Christmas tree ornaments and the like. Furthermore, the shape of the cells may vary from that shown as well as the corner posts, provided the latter have open side walls which face the adjacent cells. While the tray is normally formed of molded pulp, it may, if desired, be formed of foam plastics or similar material.

I claim:

1. A molded filler flat construction for accommodating a plurality of fragile articles, said construction comprising a plurality of article-accommodating cells arranged in side by side relation and forming a plurality of parallel rows; adjacent cells in a row being separated by upright first shoulders; corresponding cells in adjoining rows being separated by upright second shoulders; the first and second shoulders of a cell being angularly disposed relative to one another and being interconnected by upstanding hollow corner posts, each post having an upper portion projecting upwardly above upper extremities of the interconnected shoulders, said post upper portion having open side walls facing adjacent cells, upper extremities of the open side walls being interconnected by a cap section; each cell having a base section substantially delimited by wall segments extending divergently upward therefrom, said wall segments forming portions of the shoulders circumjacent a cell; adjacent open side walls of predetermined corner posts being interconnected by gusset segments which coact to form an upright indented intervening wall section, the latter being in substantially endwise alignment with an upper extremity of a shoulder.

2. The filler flat construction of claim 1 wherein the cap section of each predetermined corner post includes a plurality of radiating segments, each segment having a distal portion terminating adjacent the upper extremity of an open side wall.

3. The filler flat construction of claim 1 wherein the gusset segments of each indented intervening wall section have like triangular configurations and terminate at a recessed inner wall having a tapered configuration, said inner wall being in endwise alignment and integral with a ridge portion formed on the upper extremity of an adjacent shoulder.

4. A molded filler flat construction for accommodating a plurality of fragile articles, said construction comprising a plurality of article-accommodating cells arranged in side by side relation and forming a plurality of parallel rows; adjacent cells in a row being separated by upright first shoulders; corresponding cells in adjoining rows being separated by upright second shoulders; the first and second shoulders of a cell being angularly disposed relative to one another and being interconnected by upstanding hollow corner posts, each post having an upper portion projecting upwardly above upper extremities of the interconnected shoulders, said post upper portion having side walls facing adjacent cells, adjacent side walls of a post being separated by indented wall sections, each indented wall section having a portion thereof in substantial endwise alignment with a shoulder upper extremity, the upper extremities of the side walls being interconnected by a cap section; each cell having a base section substantially delimited by wall segments extending divergently upwardly therefrom, said wall segments including portions of the shoulders and post side walls circumjacent a cell.

5. The filler flat construction of claim 4 wherein the periphery thereof includes a pair of opposed marginal sections, each of the latter being provided with a plurality of partial cells arranged in side by side relation; adjacent partial cells being separated by upstanding partial shoulders, each partial cell having a partial base section, partial shoulder-forming surfaces extending divergently upwardly therefrom, and a full shoulder-forming surface intermediated said partial shoulder-forming surfaces, said full shoulder-forming surface being recessed from a peripheral edge of said marginal section; the peripheral edge of each marginal section of the pair being defined by exposed edges of only said partial shoulders and partial base sections forming the partial cells of said marginal section.

6. A filler flat construction of claim 5 wherein selected full shoulder-forming surfaces of each of said opposed marginal sections are recessed from the periphery of said opposed marginal section and are provided with finger openings.

7. The filler flat construction of claim 4 wherein the portion of each post included in the wall segments of an adjacent cell is angularly disposed relative to the side wall of the upper portion of said post.

8. The filler flat construction of claim 7 wherein each cell has substantially diagonally opposed corner posts and the side walls of the upper portions of the diagonally opposed corner posts are substantially vertically disposed and the portions of the diagonally opposed corner posts included in the wall segments of the cell converge downwardly from the upper portion side walls towards the cell base section.

* * * * *